United States Patent [19]

Jamora

[11] Patent Number: 5,044,329

[45] Date of Patent: Sep. 3, 1991

[54] ADJUSTABLE PUSHROD GUIDE PLATE ASSEMBLY

[76] Inventor: Vince Jamora, 4418 Emerald St., Torrance, Calif. 90503

[21] Appl. No.: 524,035

[22] Filed: Jun. 19, 1990

[51] Int. Cl.[5] ..... F01L 1/46

[52] U.S. Cl. ..... 123/90.61

[58] Field of Search ..... 123/90.61, 90.62, 90.63, 123/90.64

[56] References Cited

U.S. PATENT DOCUMENTS

| | | | |
|---|---|---|---|
| 3,086,507 | 4/1963 | Mooney, Jr. | 123/90.61 |
| 4,453,505 | 6/1984 | Holtzberg et al. | 123/90.61 |
| 4,850,315 | 7/1989 | Mallas | 123/90.61 |
| 4,856,467 | 8/1989 | Kronich | 123/90.61 |

*Primary Examiner*—David A. Okonsky
*Assistant Examiner*—Weilun Lo

[57] ABSTRACT

An adjustable pushrod guide plate assembly comprising a male plate and a female plate is disclosed. The adjustable guide plate allows a wide range utility with minimal or no modification to the guide plate.

4 Claims, 1 Drawing Sheet

ADJUSTABLE PUSHROD GUIDE PLATE ASSEMBLY

FIELD OF INVENTION

My invention relates to guide plates used on internal combustion (ohv) overhead valve engines.

DESCRIPTION OF STANDARD GUIDE PLATES

A guide plate aligns pushrods thru cylinder heads on an internal combustion (ohv) overhead valve engine. Guide plates are positioned between the rocker arm stud and the "boss" flat machined area on top of a cylinder head. There is one guide plate per cylinder with two cutouts or guide slots per plate (one to guide the intake and the other the exhaust pushrods.) Standard type guide plates are a "fixed" item and when installing them on high-performance factory or aftermarket cylinder heads from other manufactures which have relocated intake cylinder ports, the pushrods will no longer line up properly with the fixed plate. In order to make these guide plates work on these cylinder heads, the guide plates must be cut in two and either have a section removed and then welded back together or a section must be added and then welded back together (depending on wether the plate must be brought in or moved outward.)

SUMMARY OF INVENTION

My guide plates are fully adjustable to minimize modifications if any associated with high performance factory or aftermarket aluminum or cast iron cylinder heads where intake ports have been relocated from their orginal standard factory position.

DESCRIPTION OF THE PREFERRED EMBODIMENT

Figure 1:
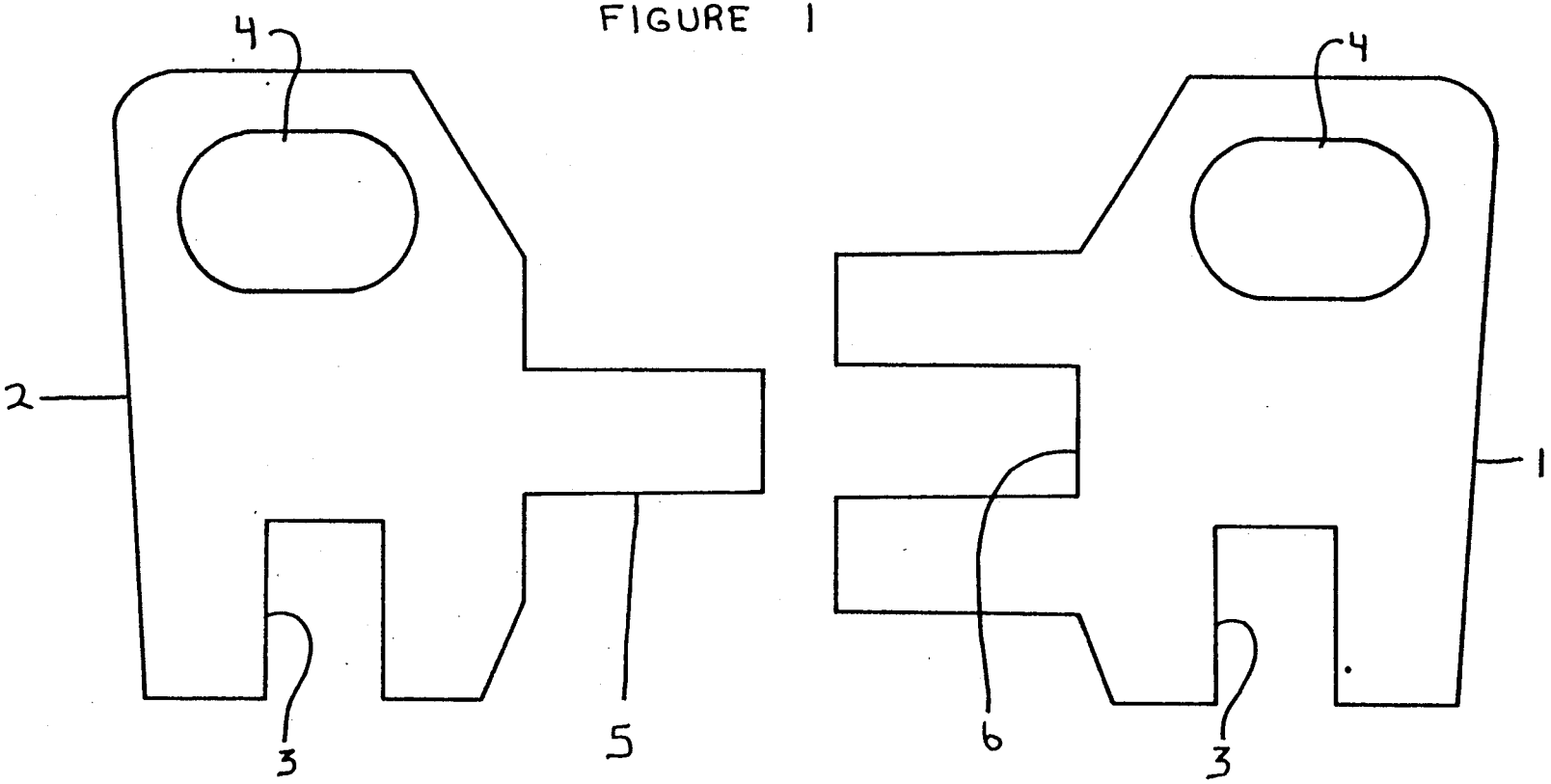
FIG. 1 is a top plane view of the adjustable pushrod guide plate assembly.

The adjustable pushrod guide plate assembly consists of two plates per cylinder instead of one. Each pair of plate assembly is comprised of a female plate 1 and a male plate 2. Both the female section 1 and the male section 2 include a pushrod guide slot 3 and an elongated mounting slot 4. The male plate 2 includes a projecting tab 5 to match a complementary slot 6 in the female plate. The plate assembly may be mounted onto the cylinder heads of the internal combustion engine by utilizing the existing stud boss (not shown). The elongated mounting slot 4 provides the latitude of adjustment. The plates can be easily adjusted inward or outward depending on the application. When the desired adjustment is reached, the assembly can be locked into place by torquing down the rocker arm stud (not shown). Due to the adjustability, the guide plate assembly require minimal or no modification. For additional stability, the guide plates can be spot welded once final adjustment is made. Although the plates may be constructed of various materials, one such construction could be 1065⅛" steel and laser cut.

What I claim is:

1. A fully adjustable two piece pushrod guide plate assembly to guide pushrods in an internal combustion engine comprising a first plate and a second plate, each of said plates including a pushrod guide slot and an elongated mounting slot, one of said plates including a projecting tab to match a complementary slot in the other of said plates.

2. The plate assembly of claim 1, wherein the plates are constructed of 1065⅛" steel, laser cut.

3. The plate assembly of claim 1, wherein said plate assembly is mounted onto the cylinder heads of the internal combustion engine by utilizing the existing stud boss with the latitude of adjustment being provided by the elongated mounting slots on each of said plates, once adjustment is complete, the two piece guide plate is secured with a screw in stud.

4. The plate assembly of claim 1, wherein after final adjustment is made, the guide plates are spot welded together for additional stability.

* * * * *